United States Patent [19]

Drucker

[11] 3,940,881

[45] Mar. 2, 1976

[54] PUSH TOY

[76] Inventor: Howard L. Drucker, 35 Great Rock Road, Sherborn, Mass. 01770

[22] Filed: Dec. 23, 1974

[21] Appl. No.: 535,214

[52] U.S. Cl. ..... 46/234; 46/220

[51] Int. Cl.[2] ..... A63H 33/26; A63H 33/02

[58] Field of Search ..... 46/202, 230, 234, 235, 46/236, 238, 241, 220, 114, 112, 1 B, 205, 97, 98, 99, 106

[56] References Cited

UNITED STATES PATENTS

| | | | |
|---|---|---|---|
| 1,171,972 | 2/1916 | Myers | 46/235 X |
| 1,596,200 | 8/1926 | McLaren | 46/114 X |
| 1,911,392 | 5/1933 | Redmond | 46/234 |
| 1,969,407 | 8/1934 | Kingsbury | 46/220 |
| 2,540,216 | 2/1951 | Quinby | 46/238 |
| 2,647,343 | 8/1953 | Zileri et al. | 46/220 |
| 2,842,896 | 7/1958 | Sire | 46/238 |
| 3,169,345 | 2/1965 | Marmo et al. | 46/241 |

*Primary Examiner*—Louis G. Mancene
*Assistant Examiner*—J. O. Lever
*Attorney, Agent, or Firm*—Morse, Altman, Oates & Bello

[57] ABSTRACT

A toy for use by children which can be pushed and steered and which upon its front end includes a bumper having an electromagnet for magnetically attracting a cooperative magnet on a rear of a toy vehicle so that the vehicle can be pushed into different directions, and the electromagnet being manually controlled by a push button located near a steering wheel.

8 Claims, 5 Drawing Figures

PUSH TOY

This invention relates generally to push toys.

A principal object of the present invention is to provide a push toy which enables a child to steer while walking upright.

Another object of the present invention is to provide a push toy which may be made in various sizes so as to suit different age groups of children.

Still a further object of the present invention is to provide a push toy which is adaptable to magnetically engage toy vehicles in front thereof so that the toy vehicles can be pushed into any desired direction.

Other objects are to provide a push toy which is simple in design, inexpensive to manufacture, rugged in construction, easy to use and efficient in operation.

These and other objects will be readily evident upon a study of the following specification and accompanying drawing wherein.

Figure 1:
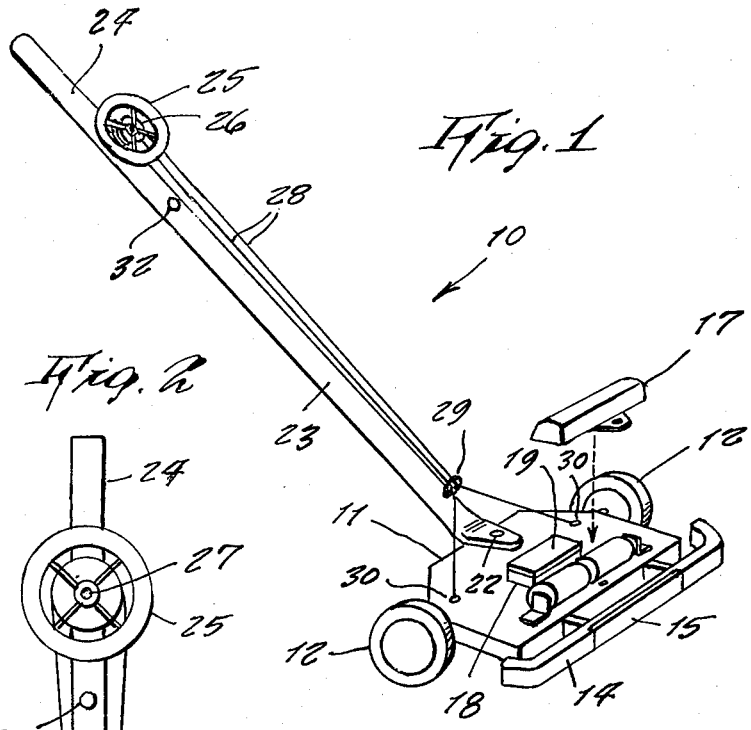
FIG. 1 is a perspective view of the present invention and showing a cover for enclosing the batteries, shown removed.
Figure 2:
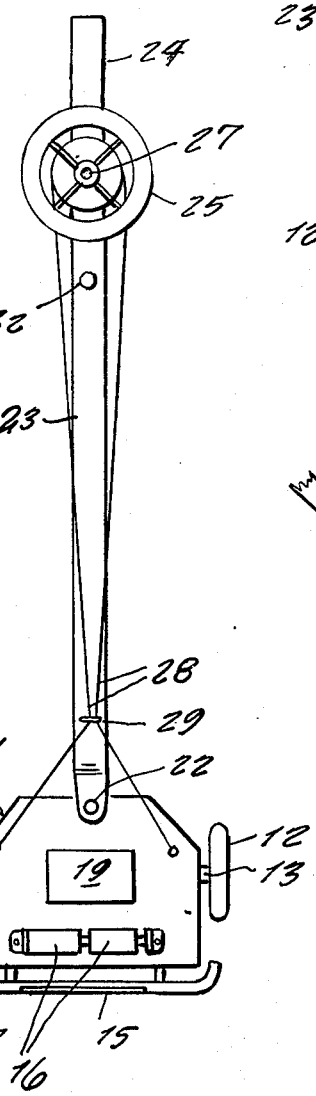
FIG. 2 is a top front view of and shown including the batteries exposed.
Figure 3:
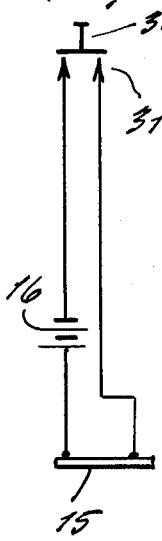
FIG. 3 is an electrical circuit of the invention.

Referring now to the drawing in detail, the reference numeral 10 represents a push toy according to the present invention wherein there is a carriage 11 that is mounted upon a pair of side wheels 12 rotatable about axles 13 that are axially aligned and secured to the carriage 11. Upon a front end of the carriage there is front bumper 14 which at its center has an electromagnet 15 built into it, the electromagnet 15 being in electrical circuit with a pair of dry cell batteries 16 mounted on top of the carriage 11 and which are protectively enclosed under a removable top cover 17 that allows the batteries to become replaced after worn out. Additionally the circuit includes a push button switch, to be described later, and which serves to open and close the circuit.

Figure 5:
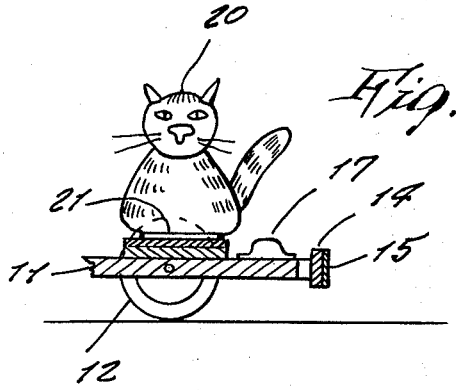
FIG. 5 is a fragmentary side cross-sectional view of the carriage of the push toy and showing a removable magnetized toy placed upon a magnetic space of the carriage.

Also on top of the carriage 11 there is mounted a block 18 upon which is mounted a magnet 19, the purpose of the block 18 being so that the magnet 19 is at least at an elevation equal to the top of the cover 17 so that when a toy 20 having a magnet base 21 therebeneath is placed upon the magnet 19, it does not interfere with the battery cover 17. As shown in FIG. 5, such toy 20 can represent an animal or any other happy figure that pleases a child.

The carriage is attached by means of a single pivot pin 22 to one end of an elongated stick 23 and which at its opposite extreme end forms a handle 24 for being grasped in the hands of a child. Near the handle 24 there is a steering wheel 25 rigidly secured to a turning shaft or winch 26 and which are rotatable about a pin 27 mounted upon the stick 23. A pair of nylon cables 28 are each wound up at their one ends upon the winch 26, the nylon cables extending therefrom through an eye bolt 29 mounted upon a lower end of the stick 23, and the terminal ends of the nylon cables are then attached at 30 near opposite side edges of the carriage so that when the steering wheel is rotated in one direction, the carriage turns in that particular direction, and when the steering wheel is turned in an opposite direction, the carriage turns likewise opposite, thus rotation of the steering wheel causes the carriage to be steered into any desired direction.

The switch 31 of the electric circuit is mounted on the stick 23 and includes a push button 32 that is located on the steering wheel so that a child can readily reach the same in order to close the electrical circuit in order that the electromagnet is activated for magnetically attracting other objects that are of steel or cooperative magnet material.

Figure 4:
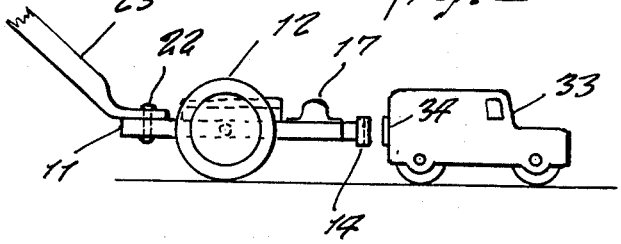
FIG. 4 is a fragmentary side elevation view of the invention and shown in position for magnetically attracting a vehicle toy for pushing the same.

As shown in FIG. 4, the present invention can include or be associated with vehicle toys 33 of various design and which upon their rear end have a magnet 34 for being attracted by the electromagnet 15.

In operative use, by pushing the push button 32, the electromagnet 15 is activated so that when positioned against the rear end of the toy vehicle 33, the cooperative magnet 34 is attracted to magnet 15 and thus is pushed by the push toy. Thus the toy vehicle can be pushed into any desired direction as the child controls the steering wheel.

This toy will give the child the delight of driving his friends imaginatively carried within the toy vehicle or else in the form of dolls or other toys 20 that are placeable upon the magnet 19.

The Happy Wheels push toy can be made in any of various different attractive colors so as to appeal visually to children.

While various changes may be made in detailed construction, it is understood that such changes will be within the spirit and scope of the present invention as defined in the present claims.

What I claim is:

1. In a push toy the combination of a carriage is supported upon a pair of side wheels, said wheels being mounted upon axles in axial alignment with each other and secured to said carriage, a control stick being attached to said carriage at one end, an opposite end of said stick forming a handle for being held in a child's hand, and means for magnetically attaching other toys to said carriage, a front side of said carriage includes a front bumper, said front bumper having an electromagnet built thereinto, said electromagnet being an electrical circuit with a switch and dry cell batteries, said dry cell batteries being carried upon said carriage and enclosed by a removable top cover, said stick is pivotally attached to said carriage by means of a singular pivot pin, a steering wheel secured to a winch being pivotable about a pin secured on said stick, said winch having one end of a pair of nylon cables wound therearound, the opposite ends of said nylon cables extending through an eye bolt secured upon said stick, and the terminal ends of said nylon cables being secured to opposite side areas of said carriage, whereby rotation of said steering wheel causes turning said carriage to right or left.

2. The combination as set forth in claim 1, wherein said switch includes a push button that is located on said stick relatively close to said steering wheel.

3. The combination as set forth in claim 2, wherein a magnet upon said carriage magnetically secures thereupon toys having magnet bases.

4. The combination as set forth in claim 3, wherein toy vehicles having a magnet on a rear are magnetically attracted for engaging said electromagnet of push toy.

5. A push toy comprising a carriage; a pair of wheels rotatably mounted to said carriage for supporting said carriage; a control stick extending from said carriage, one end of said control stick pivotally mounted to said carriage, an opposite end of said control stick defining a handle; a steering wheel rotatably mounted to said control stick; cable means attached to said steering wheel and said carriage, rotation of said steering wheel causing said carriage to turn relative to said control stick; an electromagnet mounted to said carriage, said electromagnet having energized and deenergized states; and means for energizing said electromagnet for magnetically coupling a toy to said carriage.

6. The push toy as claimed in claim 5 wherein said means for energizing includes a switch having ON and OFF states and at least one battery, said battery connected to said electromagnet through said switch, an electrical path established between said electromagnet and said battery when said switch is in said ON state, said electromagnet in said energized state when said switch is in said ON state, said electromagnet electrically disconnected from said battery when said switch is in said OFF state, said electromagnet magnetically coupling a toy to said carriage only when said electromagnet is in said energized state.

7. The push toy as claimed in claim 5 wherein said wheels are rotatably mounted on opposite sides of said carriage, said control stick extending from a rearward portion of said carriage, said electromagnet mounted to a forward of said carriage.

8. The push toy as claimed in claim 7 including a bumper mounted to said forward portion of said carriage, said electromagnet mounted to said bumper.

* * * * *